US006177739B1

(12) United States Patent
Matsudaira et al.

(10) Patent No.: US 6,177,739 B1
(45) Date of Patent: Jan. 23, 2001

(54) ELECTRIC POWER SOURCE FOR EQUIPMENT HAVING POWER SAVING MODE, POWER SAVING CONTROL DEVICE AND IMAGE FORMING APPARATUS HAVING THE POWER SOURCE

(75) Inventors: Tadashi Matsudaira; Masashi Sugano; Hiroshi Oyama; Masayuki Watanabe, all of Hachioji (JP)

(73) Assignee: Konica Corporation (JP)

( * ) Notice: Under 35 U.S.C. 154(b), the term of this patent shall be extended for 0 days.

(21) Appl. No.: 09/178,301

(22) Filed: Oct. 23, 1998

(30) Foreign Application Priority Data

Oct. 28, 1997 (JP) ..... 9-295596

(51) Int. Cl.[7] ..... H01H 47/00

(52) U.S. Cl. ..... 307/125; 307/80; 307/81; 399/81; 399/88

(58) Field of Search ..... 307/125, 80, 81, 307/85–87, 29, 64–66, 23, 25; 713/324, 320–323; 399/81, 88, 89; 363/69, 70

(56) References Cited

U.S. PATENT DOCUMENTS 4,745,436 * 5/1988 Matsuura ..... 355/14 R
5,289,046 * 2/1994 Gregorich et al. ..... 307/66
5,457,516 * 10/1995 Kim ..... 355/208
5,642,185 * 6/1997 Altrieth, III et al. ..... 399/81

* cited by examiner

*Primary Examiner*—Fritz Fleming
(74) *Attorney, Agent, or Firm*—Jordan B. Bierman; Bierman, Muserlian and Lucas

(57) ABSTRACT

In an electric power supply for supplying electric power, after a power factor has been improved, to an equipment having a power saving mode which is transferred to the power saving mode when the equipment is not operated for a predetermined period of time, the electric power supply includes: a power factor improvement section for improving the power factor by a switching operation; and a switch provided between a power source and the power factor improvement section for switching the electric power to either the power factor improvement section or the equipment. When the equipment is transferred to the power saving mode, the electric power is supplied by the switch to the equipment without passing through the power factor improvement section.

6 Claims, 5 Drawing Sheets

ELECTRIC POWER SOURCE FOR EQUIPMENT HAVING POWER SAVING MODE, POWER SAVING CONTROL DEVICE AND IMAGE FORMING APPARATUS HAVING THE POWER SOURCE

BACKGROUND OF THE INVENTION

The present invention relates to an electric power source to supply the electric power to an equipment which is transferred to a power saving mode when it is not operated for a predetermined period of time, a power saving control device to transfer the equipment to the power saving mode when it is not operated for a predetermined period of time, or to an image forming apparatus which is transferred to the power saving mode when it is not operated for a predetermined period of time in a standby mode in which an image can be formed instantly, and specifically to a device by which the electric power saving is more promoted.

Recently, in electrical apparatus, for example, apparatus such as an image forming apparatus, various improvements are made according to requirements for power saving. In the image forming apparatus, the apparatus has, for example, a power saving mode by which power consumption is more saved rather than a standby mode by which an image can be instantly formed, and when the apparatus is not operated for a predetermined period of time, the apparatus is automatically transferred into a power saving mode for saving the power consumption, and thus the electric power saving is promoted. On the other hand, for power factor improvement of overall apparatus, and for higher harmonic suppression, recently, a power source, in which a power factor improvement section such as an active filter is provided, is developed.

In this power factor improvement section, the power factor is improved by a switching operation using a switching circuit, and generation of higher harmonic is suppressed.

However, when the image forming apparatus is transferred into the power saving mode, in spite of small power consumption of the image forming apparatus itself, electric power is wastefully consumed by a switching operation of the power factor improvement section, and on the contrary, the electric power saving is prevented.

On the other hand, in order to return the image forming apparatus to the standby mode after the apparatus has been transferred to the power saving mode, it is required to operate an operation section of the image forming apparatus. However, in the operation section of the recent image forming apparatus, a touch-panel is provided to operate such operation visually. However, it is required for the touch-panel to detect the information of a pressed position, and the power consumption for this operation can not be neglected.

Further, recently, as a standard for power saving, the Energy-star is spread, in which, basically, 3 modes are regulated as the power saving mode according to passage of time. However, in the conventional image forming apparatus, 2 switches for the main power supply and the power saving are provided in the operation section, and the apparatus is transferred into the power saving mode by pressing the power saving switch, however, 3 power saving modes according to the Energy-star can not be directly selected.

SUMMARY OF THE INVENTION

In view of the noted above, an object of the present invention is to promote the more energy saving.

The above object is attained by any of the following structures.

The First Structure:

In an electric power supply to supply the electric power to equipment after a power factor has been improved by a switching operation in a power factor improvement section, the object is attained by an electric power supply for equipment having a power saving mode characterized in that, in the power supply for equipment having a power saving mode by which the electric power is supplied to the equipment which is transferred to the power saving mode when the equipment is not operated for a predetermined period of time, when the equipment is transferred to the power saving mode, the electric power is supplied due to an operation of a switching means to the equipment without passing through the power factor improvement section. Further, the power supply is structured such that the power source has a plurality of DC/DC converters to transform the electric power supplied through the power factor improvement section in the voltage, and when the equipment is transferred to the power saving mode, the electric power is supplied by the switching means from the DC/DC converter to the equipment without passing through the power factor improvement section.

The Second Structure:

In a power saving control device by which an equipment provided with an operation section having a touch-panel to detect the information of a pressed position by a coordinate detecting circuit, and a switch, is transferred to a power saving mode when the equipment is not operated for a predetermined period of time, the object is attained by the power saving control device characterized in that, when the equipment is transferred to the power saving mode, the coordinate detecting circuit is not operated, and detection whether the switch is pressed or not, is conducted, and when it is detected that the switch is pressed, the equipment is made to return from the power saving mode. Further, when the equipment having an operation section control means for controlling the operation section is transferred to the power saving mode, the operation section control means is intermittently started at a predetermined interval, and detects whether the switch is pressed or not.

The Third Structure:

The object is attained by an image forming apparatus which is transferred to a power saving mode when the apparatus is not operated for a predetermined period of time, in a standby mode in which an image can be formed instantly, the image forming apparatus characterized in that, in the power saving mode, the apparatus has a first power saving mode in which the lower electric power is consumed than the electric power consumed in the standby mode; a second power saving mode in which the lower electric power is consumed than that consumed in the first power saving mode; and a third power saving mode in which the lower electric power is consumed than that consumed in the second power saving mode, and the apparatus is structured such that the apparatus can be transferred to each power saving mode with the passage of time, and is provided with a first switch to transfer the apparatus into the first power saving mode, a second switch to transfer the apparatus into the second power saving mode, and a third switch to transfer the apparatus into the third power saving mode. Further, the first switch is a push type switch, and the second and the third switches are latching type switches, and when the image forming apparatus is in the standby mode, the first power saving mode, or the second power saving mode, the on/off operation of the second switch is made effective, and when the image forming apparatus is in the standby mode or the first power saving mode, the first switch is made effective.

DETAILED DESCRIPTION OF THE PREFERRED EMBODIMENT

Figure 1:
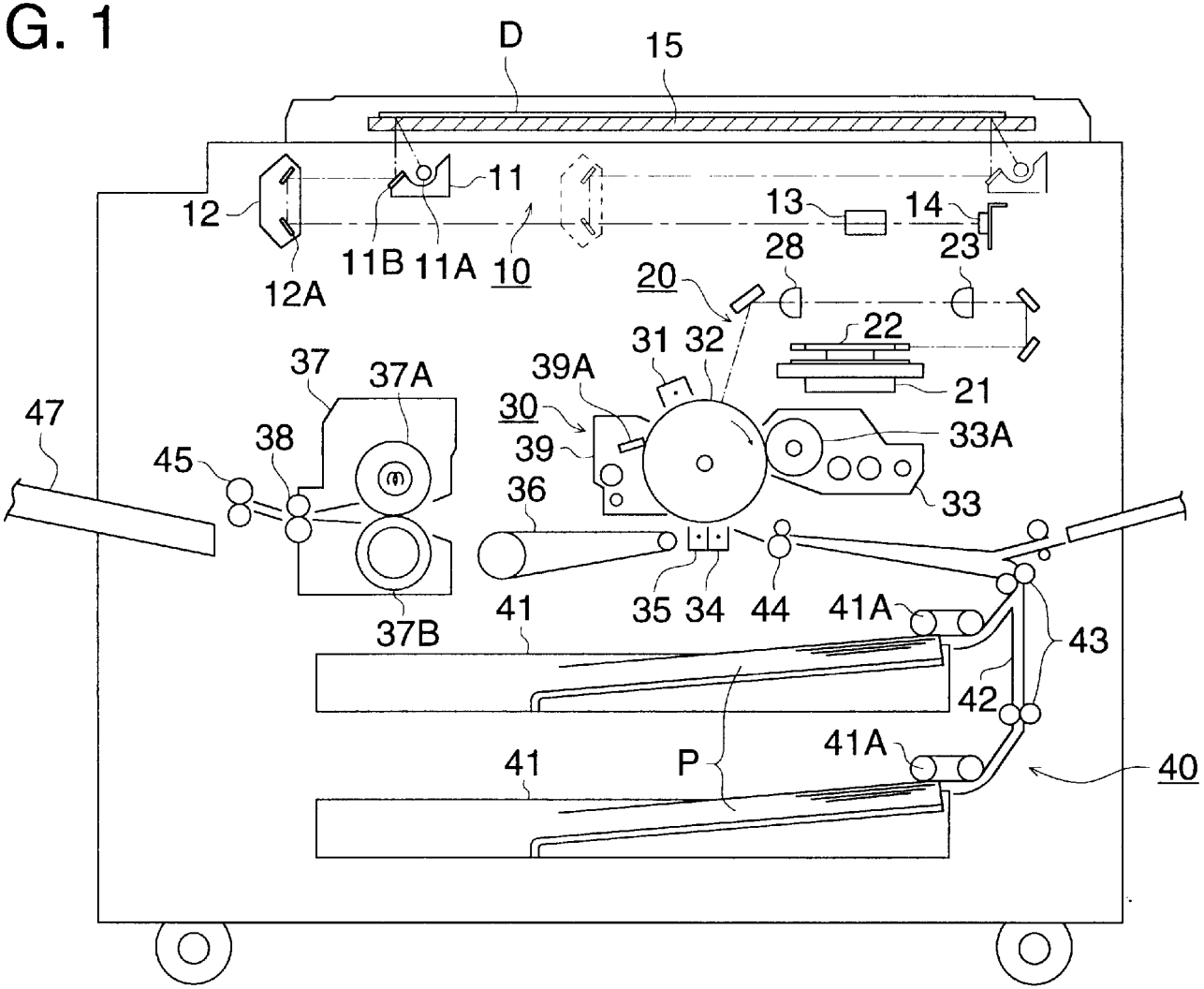
FIG. 1 is a general sectional view of an image forming apparatus (copier).
Figure 2:
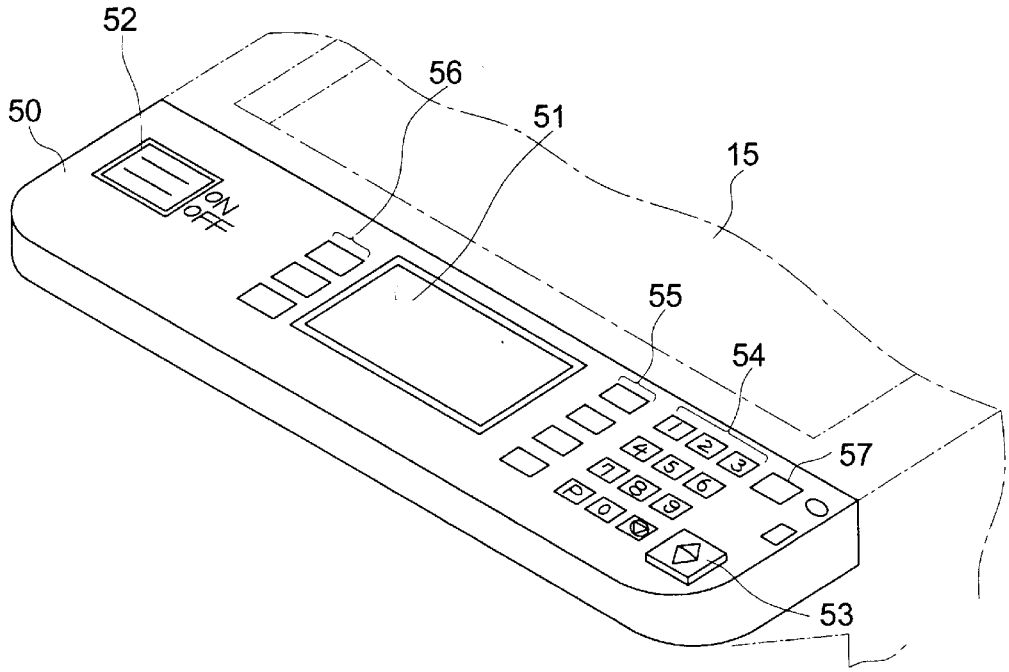
FIG. 2 is an perspective view of an operation section of the image forming apparatus.

Prior to description of the present example, an image forming apparatus to which the present invention is applied, will be described below. FIG. 1 is a general sectional view of an image forming apparatus (copier), and FIG. 2 is a perspective view of an operation section of the image forming apparatus. The image forming apparatus is composed of an image reading section 10, a laser writing section 20, an image forming section 30, a sheet feeding section 40 and an operation section 50.

In the operation section 50, a touch-panel 51 to display conditions of the image forming apparatus or conditions for each kind of settings (a condition of density or a magnification ratio) and to be capable of conducting each kind of settings by the operator's pressing, and various switches are provided. As the various switches, a power source switch 52, a copy button 53 for copy starting, a numerical button group 54 for setting the number of copy volumes, a button group 55 for the way to use the apparatus (help), and for automatically resetting a job memory or various setting values to return them to the initial values, a button group 56 to set a sorter to be provided as an option, and further a pre-heating switch 57, or similar buttons, are provided.

Prior to the copy operation, the operator sets a power source plug (not shown) into a plug socket, and the power source of the image forming apparatus is turned on. According to this operation, the image forming apparatus is initialized, and is transferred to a standby mode in which image formation can be carried out at once. After the image forming apparatus has been transferred to the standby mode, the operator places a document D on a platen 15. Then, the touch-panel 51 or various kinds of switches provided in the operation section 50 are operated, and conditions (density, magnification, the number of copy volumes) of the copy operation are set, and the copy operation is started by pressing the copy button 53.

The first mirror unit 11 provided with an illumination lamp 11A and a mirror 11B in the image reading section 10 is moved parallelly from a position shown by a solid line to a position shown by a dashed line. The second mirror unit 12 provided with a pair of mirrors (V-mirror) 12A is moved to follow the first mirror unit 11 at a half moving speed of the first mirror unit 11. By the movement of the of the first and second mirror units 11 and 12, an image of the document D placed on the platen is scanned and exposed, and is photo-electrically converted by a line CCD 14 which is an image sensor extending in the primary scanning direction. The photo-electrically converted electrical signal is image processed, and is temporarily stored in a memory (not shown), which is an image memory means, as an image signal.

Next, when the image signal stored in the memory is inputted into the laser writing section 20, laser beams are emitted from a semiconductor laser(not shown). The emitted laser beams pass through a cylindrical lens (not shown), and are projected onto the rotary surface of a polygonal mirror 22 rotating in the arrowed direction by a drive motor 21.

The projected laser beams are reflected by the movement of the rotary surface of the polygonal mirror 22 and rotational scanning is conducted, and pass through an fθ lens 23 and the cylindrical lens 28, and scan and expose a photoreceptor surface of a photoreceptor drum 32, which is an image carrier and is previously electrically charged (uniformly charged) by a scorotron charger which is a charger 31. Accordingly, an electrostatic latent image of the document image is formed on the peripheral surface of the photoreceptor drum 32 by the primary scanning by the laser beams and the subsidiary scanning by the rotation of the photoreceptor drum 32. The electrostatic latent image is reversal-developed to a toner image by toner carried on a developing sleeve 33A, by applying development bias voltage onto the developing sleeve 33A of a developing device 33, which is a development means.

On the other hand, a transfer sheet P of specified size (or type) is carried from each sheet feed cassette 41 loaded into the sheet feed section 40, by the operation of carrying-out roller 41A of the sheet feed cassette 41 in which transfer sheets P are accommodated, and is fed to an image transfer section through conveying rollers 43. Thus fed transfer sheet P is fed to the transfer section in timed relationship with the toner image on the peripheral surface of the photoreceptor drum 32, wherein the timing of the transfer sheet P is adjusted by register rollers 44. Then, the toner image is transferred onto the transfer sheet P by a corona discharger, which is a transfer device 34.

Next, the transfer sheet P is separated from the peripheral surface of the photoreceptor drum 32 by a corona discharger, which is a separator 35, and is conveyed to a fixing device 37 through a conveyance belt 36. In the fixing device 37, toner is fused on the transfer sheet P by pressure and heat of an upper roller 37*a* and a lower roller 37B, and the transfer sheet P is discharged from the fixing device 37 through conveyance rollers 38. Then, the discharged transfer sheet P is delivered on a delivery sheet tray 47 through delivery rollers 45.

On the other hand, on the photoreceptor drum 32 from which the transfer sheet p is separated, residual toner remaining on its peripheral surface is removed and cleaned by a blade 39A, which is in pressure-contact with the peripheral surface of the photoreceptor drum 32, in a cleaning device 39, and then, the photoreceptor drum 32 is electrically charged again by the charger 31, and enters into the next image forming process.

Such the image forming apparatus is structured such that it has a power saving mode in which the lower electric power is consumed than that consumed in a standby mode, and when the image forming apparatus is not operated for a predetermined period of time (a predetermined time), it is transferred from the standby mode to the power saving mode.

In such the image forming apparatus, the present invention to promote more power(electric power)saving will be described in the first example through the third example below.

(The first example)

Figure 3:
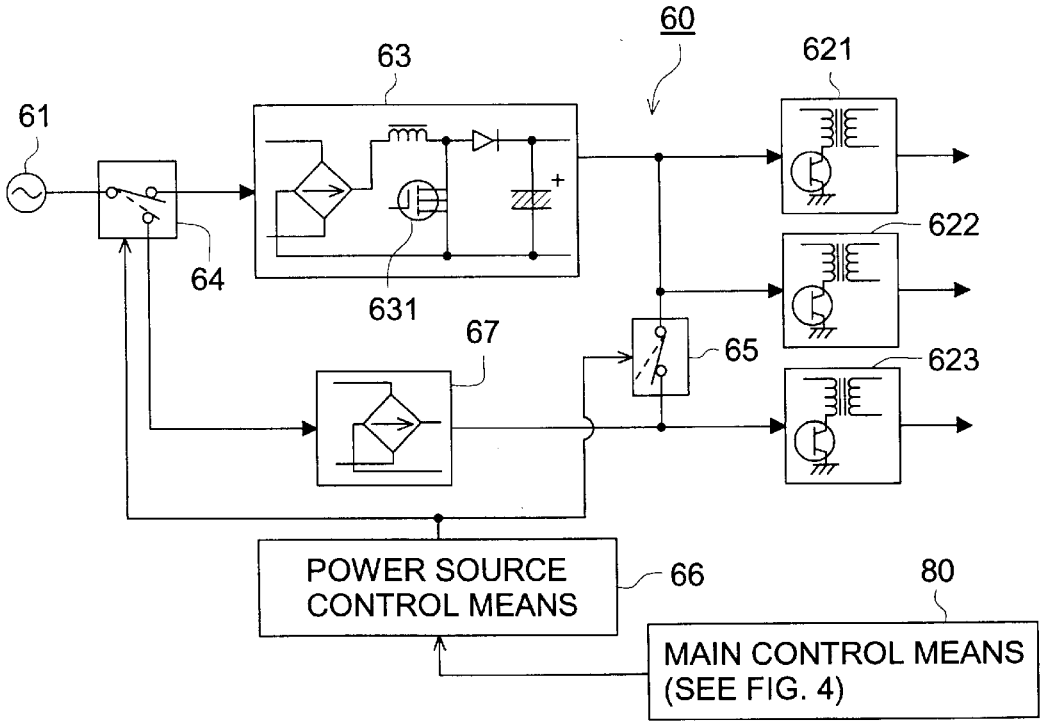
FIG. 3 is a view typically showing an power source of the image forming apparatus.

Initially, an example of the first structure will be described below based on FIG. 3 typically showing an electric power source 60 of the image forming apparatus. The electric power source 60 is structured such that an AC power source 61 obtained through a power source plug is converted to a DC power source through a rectifier, and after it is converted to a desired voltage value and a current value by a plurality of DC/DC converters 621 to 623, the electric power is supplied to each means of the image forming apparatus. Incidentally, circuits are written in the DC/DC converters 621 to 623 in FIG. 3, however, these are only typically shown, and the present invention is not limited to these.

In such the electric power source 60, a power factor improvement section 63 is provided between the AC power source 61 and DC/DC converters 621 to 623, and improves the power factor or suppresses generation of higher harmonics. Accordingly, the system is structured such that the electric power through the power factor improvement section 63 is supplied to the plurality of DC/DC converters 621 to 623.

The power factor improvement section 63 is composed of an active filter, and is provided with a switching transistor 631 as a switching circuit. The switching transistor 631 is feedback-controlled by a feedback control circuit, not shown, and conducts a switching operation, thereby, the power factor is improved and generation of the higher harmonics is suppressed. Incidentally, the switching circuit 631 is written in the power factor improvement section 63 in FIG. 3, however, it is only shown typically, and the switching circuit is not limited to this one. The power factor improvement section 63 of the present example has a rectifier to covert the AC power source to the DC power source, however, it may be provided separately.

Incidentally, when the image forming apparatus using such the electric power source 60 is transferred to the power saving mode, the electric power is supplied from only one DC/DC converter (in the present example, the DC/DC converter 623) of the plurality of DC/DC converters 621 to 623. In this case, the electric power consumed through the DC/DC converter 623 is slight, because the apparatus has been transferred to the power saving mode. However, in this case, when the electric power is supplied to the DC/Dc converter 623 through the power factor improvement section 63, the electric power is required to conduct the switching operation in the power factor improvement section 63, therefore, an effect of the power saving is lessened, and reversely, the wasteful electric power is consumed, thereby, the power saving is prevented.

Accordingly, the present example is structured such that, when the image forming apparatus is transferred to the power saving mode, electric power is supplied to the image forming apparatus without the aid of the power factor improvement section 63. In other words, when the image forming apparatus is transferred to the power saving mode, the electric power is supplied from only a DC/DC converter without passing through the power factor improvement section 63. According to such the structure, the electric power needed for a switching operation of the power factor improvement section 63 in the power saving mode is not necessary, and wasteful electric power is not consumed, thereby, the power saving can be promoted. In this connection, it is considered that, because the electric power does not pass through the power factor improvement section 63, troubles due to higher harmonics occur. However, because the consumed power is smaller in the power saving mode, an influence on a higher harmonic problem is smaller, thereby, an accompanying effect that the trouble hardly occurs, is also produced.

The concrete structure of the present example will be described below. The switch 64 is provided between the AC power source 61 and the power factor improvement section 63, and the switch 65 is provided between the power factor improvement section 63 and the DC/DC converter 623 to supply the electric power in the power saving mode. These and the switches 64 and 65 are switching-controlled by a power source control means 66. A signal to inform that the image forming apparatus is transferred to the power saving mode, is inputted from a main control means (not shown) of the image forming apparatus into the power source control means 66, and according to the signal, the power source control means 66 switching-controls the and switches 64 and 65. That is, when the signal informing that the image forming apparatus is transferred to the power saving mode, is inputted from the main control means, the power source control means 66 switches the switches 64 and 65 from a position shown by a solid line which shows a state of the standby mode (or operation) to a position shown by a dashed line. Thereby, when the apparatus is transferred to the power saving mode, the electric power can be supplied from the DC/DC converter 623, without passing through the power factor improvement section 63.

In this connection, in the present example, because the power factor improvement section 63 is provided with a rectifier, the present example is structured such that a rectifier 67 is provided in the system, and when the image forming apparatus is transferred to the power saving mode, after the AC power source is rectified to the DC power source by the rectifier 67, the DC electric power is supplied to the DC/DC converter 623.

(The second example)

Next, an example of the second structure will be described based on FIG. 4 which is a functional block diagram typically showing an operation section 50 of the image forming apparatus and its control, and FIG. 5 which is a flow chart of an operation section control means 71 in the power saving mode.

A main control means 80 is a control means for controlling the overall image forming apparatus by communicating with other control means, for example, a sheet feed control means (not shown) for controlling sheet feeding, or an operation section control means 71 (which will be described later) for controlling the operation section 50. The main control means 80 is structured such that the electric power is always supplied to the main control means 80 even at the time of power saving mode, and a returning operation from the power saving mode can be conducted.

The operation control means 71 is a control means for controlling the operation section, and is structured such that it detects operations (pressing) on various switches provided in the operation section 50 or operations on a touch-panel through a coordinate detecting circuit 72, and communicates with the main control means 80 to set conditions of a copy operation based on the detection, and further, it displays conditions of the image forming apparatus or various settings on the touch-panel 51 of the operation section 50, or turns various lamps(not shown)on. In this connection, the operation section control means operates based on a program stored in a memory means such as a ROM (not shown).

The coordinate detecting means 72 is a detecting circuit to detect the information of the pressed position (which position of the touch-panel 51 is pressed on) when the touch-panel 51 is pressed by the operator. Incidentally, as the touch-panel 51, any of an ultrasonic type, an electrostatic capacitance type, an optical(infrared ray) type, a strain type, or a resistance film type, may be acceptable, and the coordinate detecting circuit 72 detects the pressed position information by a circuit adapted to the type of the touch-panel 51, even if any type of touch-panel 51 is adopted. The position information detected by the coordinate detecting circuit 72 is transmitted to the operation section control means 71.

Figure 4:
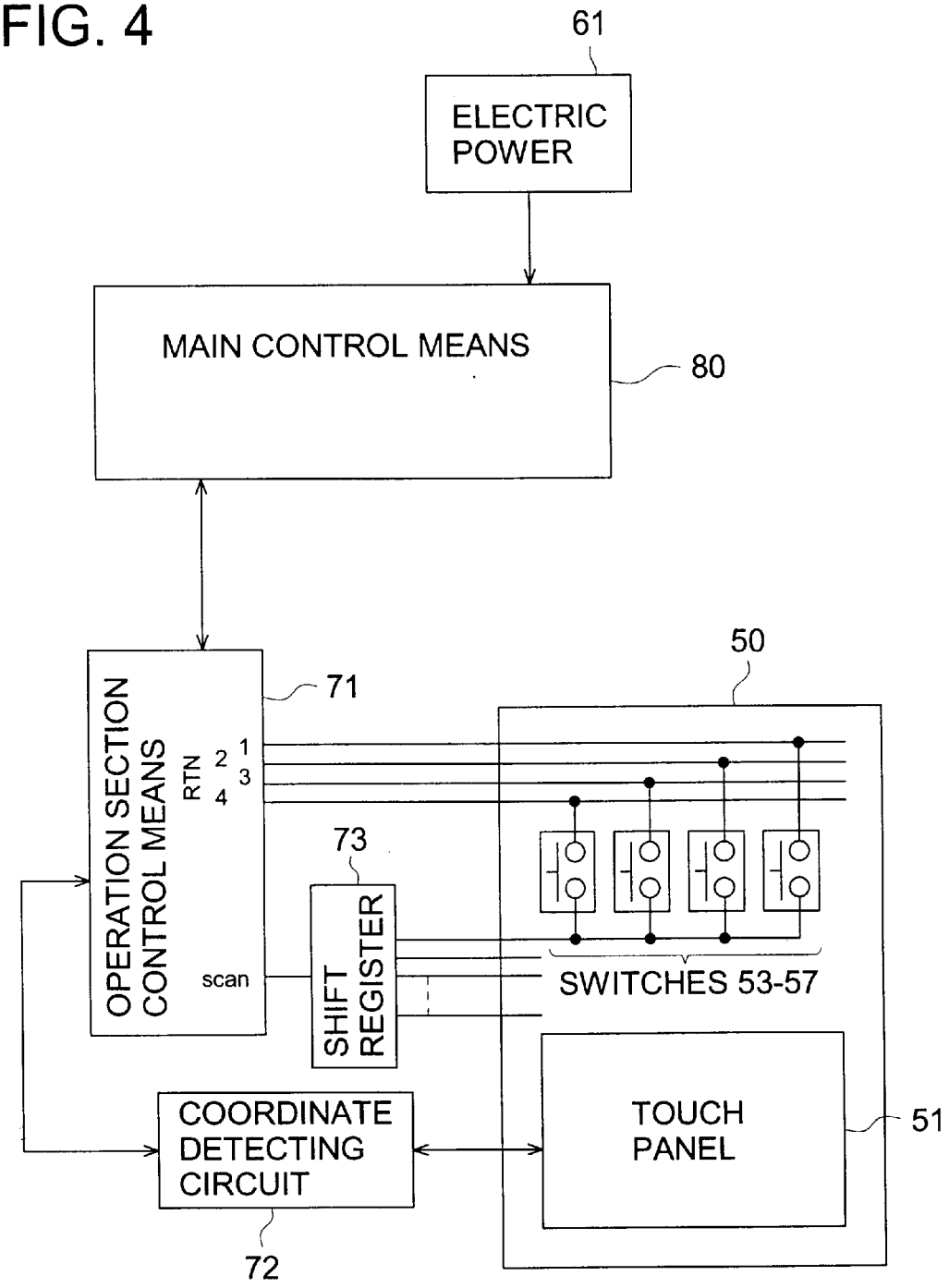
FIG. 4 is a functional block diagram typically showing the operation section of the image forming apparatus and its control.
Figure 5:
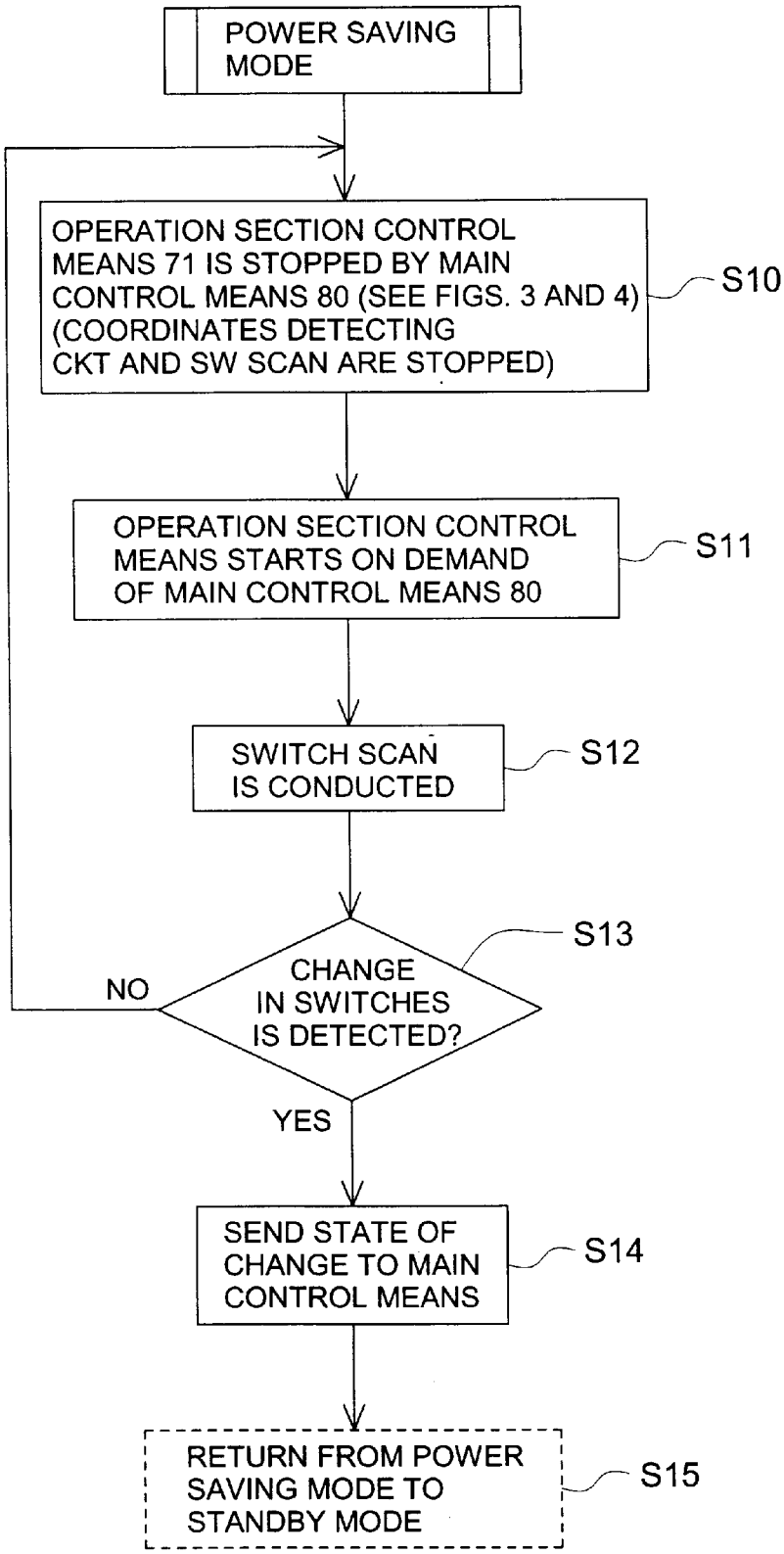
FIG. 5 is a flow chart of an operation section control means in a power saving mode.

A shift register 73 is a shift register to scan each type of switches so as to detect whether each type of switches 53 through 57 are pressed or not (in FIG. 4, only a button group 55 including a help button to instruct how to use, a job memory button, and an automatic resetting button to return each kind of settings to an initial value, is shown, however, other switches are the same). The shift register 73 scans each type of switches 53 through 57,(which is also called switch scan), according to a scan signal from the operation section control means 71, and the operation section control means 71 detects whether switches are pressed or not, through ports (in FIG. 4, 1 through 4) provided on an RTN terminal.

The operation section control means 71 is structured such that, in the standby mode, the operation section control means 71 drives the shift register 73 always or for each predetermined period of time, and conducts the switch scan to detects whether the operation section 50 is operated by the operator, and drives the coordinate detecting circuit 72 to detects information of the position at which the touch-panel 51 is pressed.

Incidentally, as described in Background of the Invention, in the conventional image forming apparatus, in order to return the apparatus to the standby mode after it has been transferred to the power saving mode, it is necessary to operate the operation section 50 of the image forming apparatus. Therefore, it is necessary to detect whether the operation section 50 is operated or not, even in the power saving mode. However, as in the present example, when the touch-panel 51 is provided in the operation section 50, it is necessary to drive the coordinate detecting circuit 72 to detect information of the position at which the touch-panel is pressed. Accordingly, even when the apparatus is transferred to the power saving mode, effects of the power saving are lessened.

Accordingly, the present example is structured such that, when the image forming apparatus is transferred to the power saving mode, the coordinate detecting circuit 72 is not operated, and when it is detected that each type of switches 53 trough 57 are pressed, the image forming apparatus is made to return from the power saving mode. In other words, the present example is structured such that, in the power saving mode, the apparatus is not returned to the standby mode, even if the touch-panel 51 is operated (pressed), and the apparatus is returned to the standby mode only when each type of switches 53 through 57 are pressed. According to the structure, even in the power saving mode, when the coordinate detecting circuit 72, in which relatively larger electric power is consumed, is not driven, the power saving can be promoted. Incidentally, in the power saving mode, as the switches 53 through 57 on which the switch scan is conducted, (it is monitored whether these switches are pressed or not), for example, a push type tact switch or the similar switch is used, and in the operation section 50, this type of switch is also acceptable for switches except the power switch 52 which is a latching type switch.

A concrete flow chart of the above description will be described below. When the image forming apparatus is transferred to the power saving mode, drive of the operation section control means 71 is stopped (electric power supply is stopped) by the main control means 80 (S10). Accordingly, the coordinate detecting circuit 72 and the switch scan (the shift register 73), which are controlled by the operation section control means 71, are stopped. Then, the operation section control means 71 is started according to the request from the main control means 80 (S11). This is, the main control means 80 intermittently controls the electric power supply at a predetermined time interval, and starts the operation section control means 71.

The started operation section control means 71 controls the operation section 50 according to a program in the power saving mode. That is, it starts the shift register 73 to conduct the switch scan (S12), and detects whether each type of switches 53 through 57 are pressed or not (there is a change or not) (S13). In this case, the operation section control means 71 does not operate the coordinate detecting circuit 72.

Then, when there is no change for all of the each type of switches 53 through 57, all the switches are not pressed by the operator, therefore, the sequence returns to S10, and the operation section control means 71 is stopped until it is started by the next request of the main control means 80.

On the other hand, when at least one of these switches 53 through 57 changes, the operation section control means 71 sends the information that the switch is pressed, that is, a state is changed, to the main control means 80 (S14). When the main control means 80 receives the information of a change of the state sent from the operation section control means 71, it makes the apparatus return from the power saving mode to the standby mode.

As described above, in the present example, the power saving is promoted by causing the coordinate detecting circuit 72 not to be driven in the power saving mode, and further, the operation section control means 71 is made to start intermittently at a predetermined time interval in the power saving mode, therefore, the electric power consumed in the operation section control means 71 is suppressed, thereby, the more power saving can be promoted.

(The third example)

Figure 6:
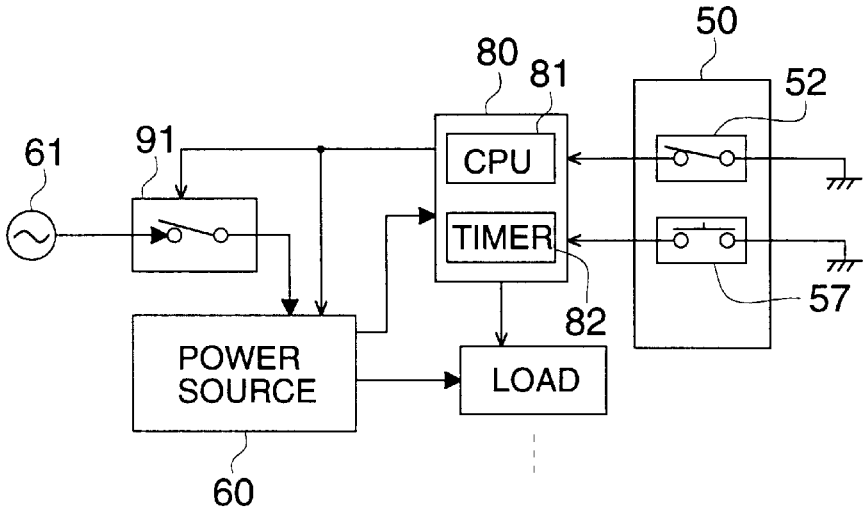
FIG. 6 is a functional block diagram.
Figure 7:
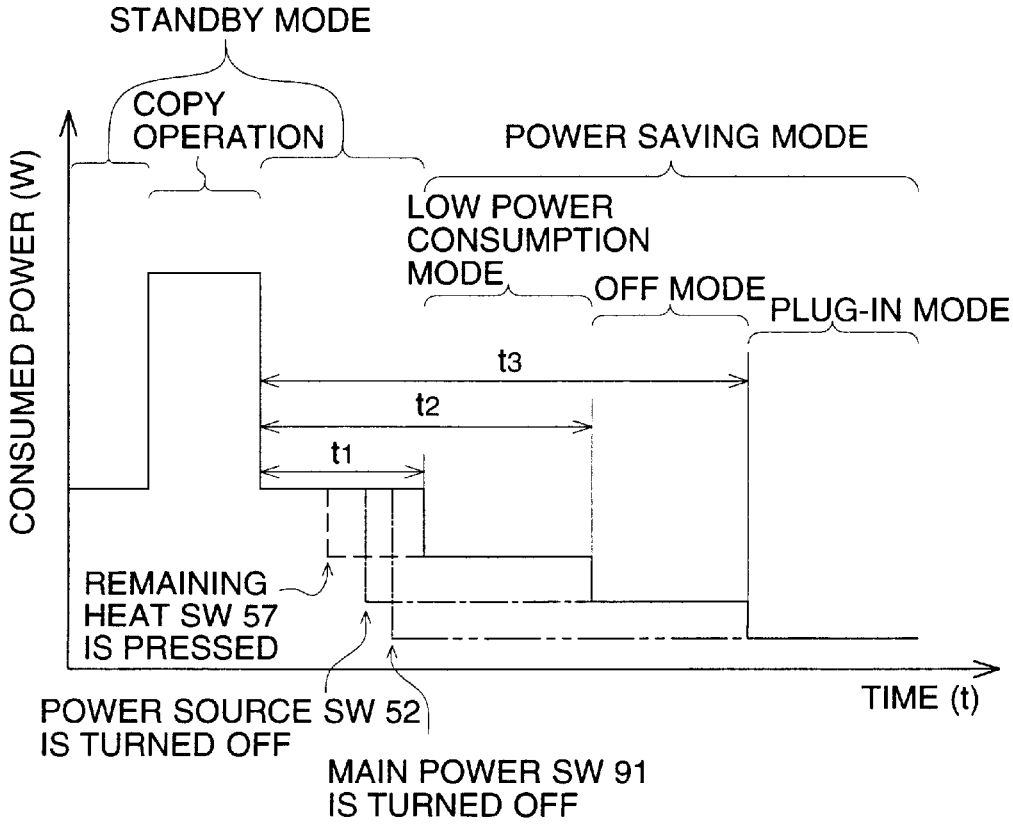
FIG. 7 is a view showing the consumed power.

Next, an example of the third structure will be described according to FIG. 6, which is a functional block diagram, and FIG. 7, which is a view showing consumed power. In this connection, in the present example, the main control means 80 is used also for controlling the operation section 50, however, as in the above-described second example, the operation section control means 71 to control the operation section 50 may be provided.

The electric power source 60 is structured such that the AC power source 61 obtained through a power plug of the image forming apparatus is converted to the DC power source so that the required power source is obtained, and further, it is converted to a required voltage value and current value, and the electric power is supplied to each means(described as loads in the drawing) of the image forming apparatus and the main control means.

The main control means 80 has a CPU 81 which functions as the center of the control, and a timer 82, and controls the overall image forming apparatus. The CPU 81 conducts processing based on a program stored in a memory means such as a ROM, not shown. The timer 82 is a clock means to count the time of no operation of the image forming apparatus in the standby mode, in which an image can be formed at once, (in other words, the time of no change of a state). In this connection, when a state is changed (for example, the copy operation is conducted) while the timer 82 counts the time, the time counting by the timer 82 is reset. Then, when the CPU detects that the counted time by the timer 82 comes to the preset time (the predetermined time), the image forming apparatus is transferred to the power saving mode. In order to transfer the apparatus to the power saving mode, the following are conducted: a control signal is sent to the electric power source 60, and the electric power is not supplied to the load itself, or the electric power is cut off; or a control signal is sent to the load itself and the consumed power is lessened.

In further description of the power saving mode, in the present example, 3 modes are provided as the power saving mode. That is, the apparatus has: a low power mode which is the first power saving mode, and in which lower electric power is consumed than the electric power consumed in the standby mode; an OFF mode which is the second power saving mode, and in which lower electric power is consumed than the electric power consumed in the low power mode; and a plug-in mode which is the third power saving mode, and in which lower electric power is consumed than the electric power consumed in the OFF mode. Then, as shown by a solid line in FIG. 7, the control means 80 controls the image forming apparatus such that the image forming apparatus is transferred from the standby mode to the low power mode, when the timer 82 counts the time t1 (in the state of standby mode) after the copy operation has been completed; further, when the timer 82 counts the time t2 after the copy operation has been completed, the apparatus is transferred from the low power mode to the OFF mode; and furthermore, when the timer 82 counts the time t3 after the copy operation has been completed, the apparatus is transferred from the OFF mode to the plug-in mode.

In this connection, in FIG. 7, the reason in which the electric power is consumed in the plug-in mode, is as follows: the image forming apparatus is provided with a load, which is driven by only inserting the power plug into a plug socket, for example, a dehumidifying heater (not shown), therefore, the electric power is consumed for the load.

However, the conventional image forming apparatus is structured such that, as a switch for controlling the power source, two switches for the main power source and power saving, are provided in the operation section, and by pressing the switch for power saving, the image forming apparatus is transferred to the low power mode. However, by such the conventional control for the power source, in the image forming apparatus having three modes as the power saving mode as in the present example, each mode can not directly be selected, and there is no method except for waiting the time count by the timer 82. Therefore, wasteful electric power is consumed only during the time count by the timer 82.

Accordingly, in the present example, as the switch operated by the operator so as to control the power source, three switches of a main power switch 91, a power switch 52 and a pre-heating switch 57, are provided.

The main power switch 91 is a latching type switch provided on the primary side, that is, between the electric power source 60 and the AC power source 61. The main power switch 91 is provided at a position separated from the operation section 50 provided at a front upper portion of the image forming apparatus, for example, on the side surface of the image forming apparatus. The system is structured such that, when the main power switch 91 is turned off, the image forming apparatus is transferred to the plug-in mode (in FIG. 7, shown by a two-dotted chain line). Accordingly, between the AC power source 61 and the main switch 91, a load which is driven by only inserting the power plug into the plug socket (for example, a dehumidifying heater, or the like), is connected.

The power switch 52 is provided on the secondary side, and is a latching type switch which is logically operated. As shown in FIG. 2, the power switch 52 is provided in the operation section 50, and its on/off operation is detected by the main control means 80. The system is structured such that, when the power switch 52 is turned off, the image forming apparatus can be transferred to an OFF mode (in FIG. 7, shown by a one-dotted chain line).

The pre-heating switch 57 is provided on the secondary side and is a logically operated push type switch, for example, a tact switch. As shown in FIG. 2, the pre-heating switch 57 is provided in the operation section 50, and it is detected by the main control means 80 whether the pre-heating switch 57 is pressed or not. The system is structured such that, when the pre-heating switch 57 is pressed in the standby mode, the image forming apparatus is transferred to the low power mode (in FIG. 7, shown by a dashed line).

As described above, in the present example, the system is structured such that three modes of the power saving mode can be sequentially transferred as the passage of time, and when switches 91, 52, 57 are provided respectively corresponding to each mode, the operator can transfer the image forming apparatus to any of three modes at an arbitrary time, that is, without waiting for the time count by the timer 82, therefore, the wasteful electric power is not consumed even in a period of the time count by the timer 82, thereby, the electric power saving can be promoted.

Further, in the present example, the system is structured such that priority is provided for these three switches 91, 52 and 57, thereby, the operability is increased. That is, when the main power switch 91 is in the on-status, (that is, the image forming apparatus is in any of the standby mode, low power mode, or OFF mode), the on/off operation of the power switch 52 is made effective. Further, when the power switch 52 is in the on-status, (that is, the image forming apparatus is in either the standby mode or the low power mode), the pre-heating switch 57 is made effective.

Incidentally, in the present example, in order to return the apparatus from the power saving mode to the standby mode, when the apparatus is transferred to the power saving mode (the low power mode, OFF mode, Plug-in mode) by the timer 82 in the passage of predetermined time, it can be carried out by pressing each kind of switches 53 through 57 as in the above-described second example. Further, when the apparatus is transferred to the low power mode by pressing the pre-heating switch 57, it can return to the standby mode by pressing each kind of switches 53 though 57 in the operation section 50 in the same manner as in the case of the transfer by the timer 82. Further, when the apparatus is transferred to the OFF mode by turning off the power switch 52, the apparatus can return to the standby mode by turning on the power switch 52. Further, when the apparatus is transferred to the plug-in mode by turning off the main power switch 91, the apparatus can return to the standby mode by turning on the main power switch 91 when the power switch 52 is in the on-status, or by turning on the main power switch 91 and the power switch 52 when the power switch 52 is in the off-status.

According to the present invention described above, for the equipment which is transferred to the power saving mode when it is not operated for a predetermined period of time, the more power saving can be promoted.

What is claimed is:

1. An electric power supply for supplying electric power to equipment, having a power factor improvement section and a power saving circuit for being activated when the equipment has not been operated for a predetermined period of time, said electric power supply comprising:

a power source for providing electric power; and switching means provided between the power source and the power factor improvement section for switching the electric power to either the power factor improvement section or the equipment, wherein when the power saving circuit is activated, the electric power is supplied by said switching means to the equipment without passing through the power factor improvement section.

2. The electric power supply of claim 1 further comprising a plurality of DC to DC converters provided between the power factor improvement section and the equipment for transforming the electric power supplied through the power factor improvement section, wherein when the power saving circuit is activated, the electric power is supplied by said switching means from the DC to DC converters to the equipment without passing through the power factor improvement section.

3. A power saving control device for establishing a power saving mode for equipment when the equipment has not been operated for a predetermined period of time, the equipment being provided with an operation section having a touch-panel to detect information from a depressed position by a coordinate detecting circuit, and a shift register for scanning one or more switches said power saving control device comprising:

a controller for activating said shift register and for bypassing the coordinate detecting circuit so as to detect whether the switches are depressed or not, when the power saving mode is established, and for causing the equipment to exit the power saving mode and enter into a standby mode, when it is detected that one or more the switches are depressed.

4. The power saving control device of claim 3 further comprising:

an operation section control means for controlling the operation section to be intermittently started at a predetermined interval, and for detecting whether the switches are depressed or not, when the equipment enters into the power saving mode.

5. An image forming apparatus which is configured to enter into a power saving mode when the apparatus is not operated for a predetermined period of time, and to enter into a standby mode in which an image can be formed instantly, and in the power saving mode, the apparatus having a first power saving mode in which a lower electric power is consumed than an electric power consumed in the standby mode; a second power saving mode in which a lower electric power is consumed than that consumed in the first power saving mode; and a third saving power mode in which a lower electric power is consumed than that consumed in the second power saving mode, and the apparatus capable of being transferred to each power saving mode with passage of time, said image forming apparatus comprising:

(a) a first switch for transferring the apparatus to the first power saving mode;

(b) a second switch for transferring the apparatus to the second power saving mode; and (c) a third switch for transferring the apparatus to the third power saving mode.

6. The image forming apparatus of claim 5, wherein the first switch is a push type switch, and the second and the third switches are latching type switches, and when the image forming apparatus is in the standby mode, the first power saving mode, or the second power saving mode, an ON or OFF operation of the second switch is made effective, and when the image forming apparatus is in the standby mode or the first power saving mode, the first switch is made effective.

* * * * *